United States Patent [19]

Stover

[11] 4,260,193

[45] Apr. 7, 1981

[54] METHOD FOR THE RENOVATION OF AN AQUIFER

[75] Inventor: Dennis E. Stover, Portland, Tex.

[73] Assignee: Atlantic Richfield Company, Los Angeles, Calif.

[21] Appl. No.: 46,276

[22] Filed: Jun. 7, 1979

Related U.S. Application Data

[63] Continuation of Ser. No. 866,750, Jan. 3, 1978, abandoned.

[51] Int. Cl.[3] ..... E21B 43/28

[52] U.S. Cl. ..... 299/5; 405/52; 423/7; 423/17

[58] Field of Search ..... 423/7, 17; 299/4, 5; 405/52

[56] References Cited

U.S. PATENT DOCUMENTS

| | | | |
|---|---|---|---|
| 2,964,380 | 12/1960 | Kolodney et al. | 423/17 |
| 3,252,920 | 5/1966 | Goren | 423/7 |
| 3,860,289 | 1/1975 | Learmont | 423/20 |
| 4,033,868 | 7/1977 | Meichsner et al. | 423/7 |
| 4,079,783 | 3/1978 | Snavely et al. | 299/4 |
| 4,108,722 | 8/1978 | Stover | 299/4 |
| 4,134,618 | 1/1979 | Kossack | 299/4 |

*Primary Examiner*—Edward A. Miller

*Attorney, Agent, or Firm*—Ronnie D. Wilson

[57] ABSTRACT

The present invention relates to a method for the renovation of an aquifer subsequent to the solution mining of a mineral from the aquifer. More specifically, the invention relates to the utilization of spent ion exchange resin to remove chloride ions from the aquifer.

1 Claim, No Drawings

METHOD FOR THE RENOVATION OF AN AQUIFER

This is a continuation of application Ser. No. 866,750, filed Jan. 3, 1978, and now abandoned.

Generally, known processes for solution mining of a mineral in situ utilize an acid or alkaline leach solution for the dissolution of the mineral. An oxidant is injected into the formation along with the leach solution. The mineral is leached from the formation and recovered from a production well via a pregnant leach solution. Various procedures for recovering the mineral from the pregnant leach solution are well known, such as ion exchange.

The method of the present invention is particularly suitable for an aquifer which has been perturbed by the leaching of uranium; however, my invention is not so limited. The following description will be in regard to uranium leached aquifers; however, it is apparent that it is applicable to aquifers perturbed during the leaching of other mineral values such as copper, nickel, vanadium, molybdenum, silver, rhenium, and selenium where similar problems are encountered.

An inherent problem of solution mining uranium via an acid or alkaline solution is the dissolving of other soluble ionic species in addition to uranium causing an increase in the level of total dissolved solids (TDS) in the aquifer fluids. Other soluble ionic species include calcium, iron, magnesium, radium, sodium, chloride, molybdenum, selenium, sulfate, and vanadium. Sources of these ions are: calcite, which dissolves to produce calcium and carbonate or bicarbonate ions; molybdenite, which produces molybdate and sulfate; and iron sulfides (marcasite and pyrite), which produce sulfate as well as both soluble and insoluble iron compounds. If such soluble species are not recovered from the pregnant leach solution during operation, they will continue to accumulate throughout the life of the leaching operation, limited only by their respective saturation maximums. The extent of this accumulation is directly measured by analysis of the TDS level of the aquifer fluid.

Primary anionic constituents of the increased TDS level are bicarbonate, carbonate, chloride and sulfate ions. Each can be present in concentrations of several hundred ppm in a perturbed aquifer fluid. The chloride and sulfate species are extremely stable, and hence, resistant to chemical reduction.

At termination of an in situ uranium solution mining operation, it is necessary to renovate the aquifer fluid to near or at its original conditions for a variety of reasons. Certain of the TDS constituents (contaminants) can be removed via conventional water purification processes. For example, the alkaline metal ions as well as chloride ions can be stripped from the fluid using ion exchange resins; however, the feasibility of such processes is limited by equipment and operating costs. Similarly, sulfate ions can be removed by precipitation of the sulfate ions in an insoluble form, for example, precipitation of insoluble barium sulfate using barium chloride as the precipitating agent. The major drawback to this method is the cost of the precipitating agent. Another renovation scheme would be to pump the contaminated fluid from the reservoir, letting native formation water flow into the contaminated region, and dispose of the contaminated fluid. Studies have shown that more than three times the volume of contaminated fluid must be pumped from the reservoir to insure approaching the original conditions within the contaminated region. The removal of such a potentially large volume of water from an aquifer may not be feasible in many areas. In addition, the removed contaminated fluid must be disposed into deep injection wells or evaporation ponds since state and federal regulatory agencies prohibit the discharge of such waters into surface waters. The costs associated with these two disposal method are substantial. In the present invention, equipment, material, and operating costs are minimized by use of spent ion exchange resin which removes chloride ions species by exchanging with sulfate ions which are then more easily removed by other means.

During the course of an in situ uranium solution mining operation, two major perturbations are inflicted upon the aquifer. Renovation of a leach reservoir to its original state is contingent upon reversal of these perturbations which are: (1) the change of the aquifer from a reduced to an oxidized state and (2) the increase of the TDS level of the aquifer from a nominal 1,000 ppm to several thousand ppm. Therefore, there is needed a method whereby these perturbations are reversed and a leached aquifer renovated to its original state for the long term.

Therefore, it is an object of the present invention to provide a method for the renovation of leached aquifers.

A further object of the present invention is to provide a method for the renovation of leached aquifers having high TDS levels in the fluids therein.

It is an additional objective of the present invention to provide a method for the renovation of a leached aquifer through the utilization of spent ion exchange resin to decrease the level of TDS present therein.

Other objects, aspects, and several advantages of the present invention will become apparent upon a further reading of this disclosure and the appended claims.

It has now been found that the objects of the present invention can be attained by contacting spent ion exchange resin from the uranium separation step of a recovery operation with the fluid from an aquifer which has been leached of its recoverable uranium.

In the operation of the present method, the spent ion exchange resin strips the undesirable chloride ions present in the aquifer and leaves sulfate as the primary contaminant in the fluid. The sulfate ion content of the aquifer fluid is then easily decreased by previously reported means such as contacting same with sulfate reducing bacteria which convert the sulfate to hydrogen sulfide. Hydrogen sulfide is a strong reducing agent and reacts with certain soluble contaminants such as iron, molybdenum, uranium, and vanadium to reduce their oxidation state and produce insoluble compounds. This reduces the TDS level of the aquifer fluid. Other soluble cations also react with hydrogen sulfide to produce insoluble sulfide salts which further reduces the TDS level of the reservoir fluid.

It is important to note that as used herein the term spent ion exchange resin refers to resin which has been utilized in the uranium recovery processes of a well; and its uranium loading capability has diminished to a commercially unacceptable level.

The following description is provided to illustrate the effective operation of the method described herein.

An ore body 35,000 square feet in area and averaging twenty feet in thickness lies at an average depth of 400 feet below the surface of the earth. The ore is primarily an unconsolidated sandstone containing approximately fifteen weight percent carbonates, two weight percent iron sulfide, and one weight percent organic carbon. The total uranium content of the ore averages 0.06 percent which is primarily uraninite.

Thirty-two wells are drilled into the ore body in an array forming twelve five-spot patterns. The wells are completed in only the mineralized zone which is vertically isolated by low permeability strata above and below. Prior to initiation of the uranium leaching operation, all wells are pumped to remove sand and drilling debris. Subsequently, samples of the native water of the mineralized zone are obtained from all wells and analyzed for chemical composition. Average values are shown in column 3 of the Table and define the baseline or original conditions of the reservoir.

Because of the high carbonate content of the aquifer, an alkaline leaching process is utilized rather than an acid leach. During the leaching process which continues for eighteen months, an ammonia bicarbonate enriched leachant is cycled through the formation. An oxidant is injected into the twenty injection wells along with the leachant. As the fluid travels through the formation, the oxidant reacts with solid uranium, sulfides, and other oxidizable species to produce soluble and insoluble reaction products. The soluble products dissolve in the leachant and are produced at twelve production wells; the uranium content of the leachant is stripped on a uranium specific ion exchange resin; the ammonia bicarbonate and oxidant concentrations are restored; and the leachant is reinjected into the formation. During this continuous cycling of leachant, no significant quantities of soluble species other than uranium are stripped from the leachant and the anion donor on the ion exchange resin, chloride, is added to the leachant. Thus, the concentrations of soluble species other than uranium in the leachant steadily increase during the operation and are limited only by their saturation or solubility maximums. At the conclusion of the leaching operation, the perturbed aquifer fluid, i.e, the leachant, is analyzed and found to have the composition shown in column 4 of the Table. A comparison of columns 3 and 4 of the Table clearly shows the magnitude of the perturbation inflicted upon the aquifer fluid. Regulatory agencies' constraints require that this perturbation be reduced to near zero prior to abandonment of the site.

A culture of Desulfivibrio desulfurican bacteria is prepared in a medium consisting of the perturbed aquifer fluid and sodium lactate which is added to accelerate growth. Portions of the culture are continuously introduced into each of the twenty injection wells for twelve hours. During this period, fluid is removed from the aquifer via the twelve production wells, innoculated with the culture, and returned to the reservoir via the injection wells. The flow rate is sufficiently low as to minimize the shear forces exerted on the bacteria and hence, their destruction. During the next four months, the wells are periodically sampled and the bacterial population monitored. At the end of this period, aquifer fluid samples are obtained from several wells and analyzed. A noticeable hydrogen sulfide odor is observed with these samples which was absent during the leaching operation. The results of the chemical analyses are shown in column 5 of the Table. Resultant from the bacterial action, drastic reductions in the ammonia, bicarbonate, calcium, magnesium, molybdenum, sodium, and sulfate concentrations as well as the TDS level have occurred.

Ammonia is consumed by the bacteria as both a nutrient and energy source. Similarly, bicarbonate is a carbon source. Calcium, magnesium, and sodium concentration reductions result from exchange with clay bound ammonium ions which are consumed by the bacteria and the solubility limitations of their respective sulfite and sulfide forms. The bacteria generated hyrogen sulfide sufficiently lowers the oxidation state of the reservoir so that molybdenum and uranium are reduced to unsoluble forms.

Complete restoration of the aquifer fluid is not yet achieved, and additional treatment is required. TDS components, namely, ammonia, bicarbonate, and sulfate, are removed. A recycle stream of the partially renovated aquifer fluid is pumped through an ion exchange column containing spent resin which is in its sulfate form. The sulfate is exchanged for chloride such that the column effluent is essentially stripped of chloride but now contains sulfate.

Column 6 of the Table shows the average effluent composition during a stripping cycle. The chloride concentration is decreased to 50 mg/l which is substantially below the baseline level of 257 mg/l. The effluent is reinjected into the formation where it dilutes the residual chloride concentration—930 mg/l; and its high sulfate level is reduced by the still active bacteria. For this example, only about 75 percent of the contaminated fluid must be processed via ion exchange to restore the average chloride concentration of the reservoir to its original level.

A test, at a near identical site in the same ore body approximately 1,000 feet removed from the present site (edge to edge), characterizes the aquifer behavior when no external renovation efforts are attempted. Operations at this site are also conducted for eighteen months under identical operating conditions. The initial and final reservoir fluid compositions are within five percent of those of the present site. At the conclusion of the leaching operation, all wells are shut in for fourteen months. During this period, only the naturally occurring processes within the aquifer interact with the perturbed aquifer fluid. At the end of this period, three wells are reactivated and sufficient fluid pumped from the aquifer to permit acquisition of representative aquifer fluid samples. Averages of analyses of these samples are shown in column 7 of the Table. Within experimental accuracy, only the decrease in uranium concentration occurs during this period.

The present invention has been described herein with reference to particular embodiments. Therefore, it will be appreciated by those skilled in the art, however, that various changes and modifications can be made therein without departing from the scope of the invention as presented.

ANALYSIS OF MAJOR DISSOLVED SOLIDS COMPONENTS IN RESERVOIR FLUID

| 1 Species | 2 Units | 3 Prior to Initiation of In Situ Alkaline Uranium Leaching | 4 At Completion (18 Months Operation) of In Situ Alkaline Uranium Leaching | 5 After 4 Month Shut In With Bacteria | 6 After Contact With Spent Ion Exchange Resin | 7 After 14 Month Shut In of Site (Post Leaching) |
|---|---|---|---|---|---|---|
| pH | | 7.4 | 7.0 | 7.3 | 7.4 | 7.2 |
| Ammonia | ppm | <1 | 145 | <1 | <1 | 130 |
| Bicarbonate | ppm | 182 | 471 | 125 | 125 | 465 |
| Calcium | ppm | 43 | 725 | 325 | 325 | 730 |
| Chloride | ppm | 257 | 950 | 930 | 50 | 946 |
| Magnesium | ppm | 10 | 100 | 35 | 35 | 95 |
| Molybdenum | ppm | <1 | 22 | <1 | <1 | 18 |
| Sodium | ppm | 187 | 578 | 220 | 220 | 580 |
| Sulfate | ppm | 42 | 2070 | 20 | 1210 | 2000 |
| Uranium | ppm | <1 | 10 | <1 | <1 | <1 |
| Total Dissolved Solids | ppm | 742 | 5020 | 1655 | 1955 | 4980 |

I claim:

1. A method for the renovation of an aquifer fluid subsequent to solution mining of uranium from an aquifer containing same and separating said uranium from said aquifer fluid via ion exchange resin which comprises removing chloride ions from said aquifer fluid with an ion exchange resin having a commercially unacceptable uranium loading capability.

* * * * *